United States Patent [19]

Adaniya et al.

[11] 3,986,843

[45] Oct. 19, 1976

[54] PROCESS FOR MANUFACTURING CHROMATED ELECTRO-GALVANIZED STEEL SHEET AND SHEET MADE THEREBY

[75] Inventors: Takeshi Adaniya; Masaru Ohmura, both of Fukuyama, Japan

[73] Assignee: Nippon Kokan Kabushiki Kaisha, Tokyo, Japan

[22] Filed: Dec. 19, 1975

[21] Appl. No.: 642,489

[30] Foreign Application Priority Data

Jan. 22, 1975 Japan ..... 50-8626

[52] U.S. Cl. ..... 29/195; 29/196.4; 204/35 R; 204/38 R; 204/43 Z

[51] Int. Cl.[2] ..... B23P 3/00; C25D 3/56; C25D 5/48

[58] Field of Search ..... 204/43 Z, 35 R, 38 R, 204/56 R; 29/196.5, 196.4, 195 T

[56] References Cited

UNITED STATES PATENTS 3,822,118 7/1974 Fukuzuka et al. ..... 204/43 Z X

*Primary Examiner*—G. L. Kaplan

*Attorney, Agent, or Firm*—Flynn & Frishauf

[57] ABSTRACT

In a Zn-ion based acidic galvanizing bath containing one additive selected from the group consisting of:

| | | |
|---|---|---|
| (a) | $Cr^{3+}$ | 50 – 700ppm, |
| (b) | $Cr^{6+}$ | 50 – 500ppm, and |
| (c) | $Cr^{3+}$and $Cr^{6+}$ | 50 – 700 ppm, in which |
| | $Cr^{6+}$being 500ppm at the maximum; | |

and at least one additive selected from the group consisting of:

| | | |
|---|---|---|
| (d) | Sn ion | 10 – 5,000ppm, and |
| (e) | In ion | 10 – 3,000ppm, |

a steel sheet is subjected to an electro-galvanizing treatment, and then, said electro-galvanized steel sheet is subjected to a conventional chromate treatment.

2 Claims, No Drawings

PROCESS FOR MANUFACTURING CHROMATED ELECTRO-GALVANIZED STEEL SHEET AND SHEET MADE THEREBY

FIELD OF THE INVENTION

The present invention relates to an improvement in the process for manufacturing a chromated electro-galvanized steel sheet, said process comprising subjecting a steel sheet to an electro-galvanizing treatment in an acidic galvanizing bath, and then, subjecting said electro-galvanized steel sheet to a chromate treatment.

BACKGROUND OF THE INVENTION

It is in general inevitable that impurities from a galvanizing apparatus, an electrode, galvanizing bath materials and a steel sheet to be electro-galvanized are entangled into a galvanizing bath during electro-galvanizing operations of the steel sheet. Impurities thus mixed into the galvanizing bath not only causes degradation of the surface quality of the produced galvanizing layer, but also exerts adverse effects on a chromate treatment to be applied thereafter. If, for example, a galvanizing bath contains $Fe^{2+}$ mixed in it as impurities, formation of a chromate film on the galvanizing layer of an electro-galvanized steel sheet is seriously impaired in applying a chromate treatment as the next step, and hence, the amount of deposited chromate is largely reduced. If, furthermore, impurities such as $Cu^{2+}$ and $Ni^{2+}$ are contained in a galvanizing bath, the amount of chromate deposited onto the galvanizing layer of an electro-galvanized steel sheet is small in applying a chromate treatment. Consequently, an intensification of chromate treatment conditions, as described later, cannot increase at all the amount of deposited chromate. As a result, it is impossible to obtain a chromated electro-galvanized steel sheet having a satisfactory corrosion resistance.

For the purpose of preventing impurities from coming into a galvanizing bath, or removing impurities from a galvanizing bath, it has been usual practice to apply a closer control over impurities in a galvanizing bath, to employ a corrosion resistant material for the construction of a galvanizing apparatus, to remove such impurities as cadmium, lead and copper dissolved in a galvanizing bath by substituting zinc for such impurities through a treatment of the galvanizing bath with zinc powder, or, to cause precipitation of such impurities as copper by suspending an iron plate in a galvanizing bath.

On the other hand, a method for intensifying chromating conditions is conventionally known, which comprises increasing the amount of deposited chromate by increasing the amount of free acid in a chromating bath, with a view to imparting a satisfactory corrosion resistance to an electro-galvanized steel sheet of which the galvanizing layer has been degraded by impurities in the galvanizing bath. The chromating bath in this method has however a strong pickling action because of its increased free acid. This method is therefore defective in that the formation of a chromate film becomes non-uniform or the increased dissolution of zinc into the chromating bath accelerates the degradation of the chromating bath. Even by such an intensification of chromating conditions, therefore, the time before occurrence of white rust in a salt spray test, for example, is not extended so much, and an improvement of the corrosion resistance of a chromated electro-galvanized steel sheet cannot be expected.

In all cases, these conventional measures to prevent impurities from coming into a galvanizing bath, to remove impurities from a galvanizing bath and to intensify chromating conditions are only passive actions aiming at preventing the adaptability to chromating of an electro-galvanized steel sheet from being impaired by impurities mixed in a galvanizing bath. These measures cannot therefore be positive actions imparting a higher corrosion resistance to an electro-galvanized steel sheet by improving its adaptability to chromating.

Also, the following methods have so far been proposed:

1. Method which comprises adding Mo and W into a galvanizing bath (refer to the Japanese Patent Publication No.25,245/71);
2. Method which comprises adding Co, Mo, W and Fe into a galvanizing bath (refer to the Japanese Patent Publication No.16,522/72);
3. Method which comprises adding Co, Mo, W, Ni, Sn, Pb and Fe into a galvanizing bath (refer to the Japanese Patent Publication No.19,979/74);
4. Method which comprises adding 0.05 – 0.3 g/l $Cr^{6+}$ into a galvanizing bath (refer to the Japanese Patent Provisional Publication No.84,040/73); and
5. Method which comprises adding 0.5 – 1.5 g/l Zr into a galvanizing bath (refer to the Japanese Patent Publication No.18,202/70).

All these methods (1) to (5) have an object to improve the quality of the galvanizing layer itself of an electro-galvanized steel sheet. The adaptability to chromating of an electro-galvanized steel sheet is not therefore improved by any of these methods, thus leading to no improvement in the corrosion resistance of the electro-galvanized steel sheet after a chromate treatment.

In view of the foregoing, a process for manufacturing a chromated electro-galvanized steel sheet has been proposed (refer to the Japanese Patent Provisional Publication No.102,538/75), with a view to increasing the amount of deposited chromate by the improvement of the adaptability to chromating of an electro-galvanized steel sheet and thus to improving the corrosion resistance of the electro-galvanized steel sheet after chromating, said process comprising: electro-galvanizing a steel sheet in a Zn-ion based acidic galvanizing bath containing an additive selected from the group consisting of:

| | | |
|---|---|---|
| (a) | $Cr^{3+}$ | 50 – 700ppm, |
| (b) | $Cr^{6+}$ | 50 – 500ppm, and |
| (c) | $Cr^{3+}$ and $Cr^{6+}$ | 50 – 700ppm, in which |
| | $Cr^{6+}$ being 500ppm at the maximum; | |

and then subjecting said electro-galvanized steel sheet to a chromate treatment. According to this method, the time before occurrence of white rust is largely extended, but sufficiently satisfactory results are not as yet available in terms of the time before occurrence of red rust, and an improvement in this respect has been expected.

SUMMARY OF THE INVENTION

An object of the present invention is therefore to provide a process for manufacturing a chromated electro-galvanized steel sheet having a large amount of deposited chromate and an excellent corrosion resistance.

Another object of the present invention is to provide a process for manufacturing a chromated electro-galvanized steel sheet, suitable for high-speed operations, capable of rapidly completing a chromate treatment following an electro-galvanizing treatment.

A principal object of the present invention is to provide a process for manufacturing a chromated electro-galvanized steel sheet which permits, in applying a chromate treatment following an electro-galvanizing treatment, acceleration of chromate deposition onto a galvanizing layer on said steel sheet.

In accordance with one of the features of the present invention, there is provided a method for manufacturing a chromated electro-galvanized steel sheet which comprises subjecting a steel sheet to an electro-galvanizing treatment in a Zn-ion based acidic galvanizing bath containing one additive selected from the group consisting of:

| | | |
|---|---|---|
| (a) | $Cr^{3+}$ | 50 – 700ppm, |
| (b) | $Cr^{6+}$ | 50 – 500ppm, and |
| (c) | $Cr^{3+}$and $Cr^{6+}$ | 50 – 700ppm, in which |
| | $Cr^{6+}$being 500ppm at the maximum; | |

and at least one additive selected from the group consisting of:

| | | |
|---|---|---|
| (d) | Sn ion | 10 – 5,000ppm, and |
| (e) | In ion | 10 – 3,000ppm; |

and then, subjecting said electro-galvanized steel sheet to a conventional chromate treatment.

DETAILED DESCRIPTION OF PREFERRED EMBODIMENTS

In view of the foregoing, the inventors have conducted an extensive study, and found as a result the possibility of accelerating chromate deposition onto the galvanizing layer on an electro-galvanized steel sheet by subjecting a steel sheet to an electro-galvanizing treatment in a Zn-ion based acidic galvanizing bath containing one additive selected from the group consisting of:

| | | |
|---|---|---|
| (a) | $Cr^{3+}$ | 50 – 700ppm, |
| (b) | $Cr^{6+}$ | 50 – 500ppm, and |
| (c) | $Cr^{3+}$and $Cr^{6+}$ | 50 – 700ppm, in which |
| | $Cr^{6+}$being 500ppm at the maximum; | |

and at least one additive selected from the group consisting of:

| | | |
|---|---|---|
| (d) | Sn ion | 10 – 5,000ppm, and |
| (e) | In ion | 10 – 3,000ppm; |

and then subjecting said electro-galvanized steel sheet to a conventional chromate treatment.

In the present invention, Cr ions such as $Cr^{3+}$ and $Cr^{6+}$, Sn ions such as $Sn^{2+}$ and $Sn^{4+}$ and In ion are estimated to be contained in the galvanizing layer of a steel sheet in the form of oxides or hydroxides and to activate the surface of said galvanizing layer, thus improving the adaptability to chromating of said electro-galvanized steel sheet.

The base of a galvanizing bath employed in the present invention may be a conventional acidic galvanizing bath. More specifically, zinc sulfate ($ZnSO_4.7H_2O$) or zinc chloride ($ZnCl_2$) is applicable as a main Zn source; ammonium chloride ($NH_4Cl$) or other ammonium salt ($NH_4X$), as an conductive assistant; and sodium acetate ($CH_3COONa$) or sodium succinate ($(CH_2COONa)_2.6H_2O$), as a pH buffer. For example, an acidic galvanizing bath of a pH of about 4, containing $ZnSO_4.7H_2O$:440 g/l; $ZnCl_2$:90g/l; $NH_4Cl$:12g/l; and $(CH_2COONa)_2.6H_20$:12 g/l, is well applicable as a base for the galvanizing bath in the present invention without any special treatment.

The electro-galvanizing conditions in the present invention may also be conventional ones, without the necessity of any modification. For example, a steel sheet may be electro-galvanized at a bath temperature of about 50° C and a current density of about 45 $A/dm^2$.

Now, the following paragraphs explain the reasons why, in the present invention, the amounts of $Cr^{3+}$, $Cr^{6+}$, Sn and In ions to be added into and contained in said conventional acidic galvanizing bath are limited as mentioned above.

1. $Cr^{3+}$ and $Cr^{6+}$

A $Cr^{3+}$ content of over 700ppm in a galvanizing bath is not desirable because of a portion remaining undissolved in the galvanizing bath. Also, a $Cr^{6+}$ content of over 500ppm in a galvanizing bath impairs the adhesion of zinc to steel sheet and produces irregularities in the galvanizing layer, thus giving an unfavorable external appearance to the electro-galvanized steel sheet. Furthermore, an excessive content of $Cr^{6+}$ in a galvanizing bath inhibits formation of a galvanizing film. On the other hand, a content of $Cr^{3+}$ and/or $Cr^{6+}$ of under 50ppm, posing no problems in the formation of a galvanizing film, the adhesion of the galvanizing film to a steel sheet, and the external appearance of an electro-galvanized steel sheet, gives no improvement in the adaptability to chromating of an electro-galvanized steel sheet.

2. Sn ion

An Sn-ion content of over 5,000ppm in a galvanizing bath causes precipitation of an undissolved portion in the galvanizing bath. In spite of the deposition of zinc, the impaired adhesion of zinc to a steel sheet prevents the formation of a galvanizing film. In the case of an Sn-ion content of under 10ppm, on the other hand, there is observed no improvement in the adaptability to chromating of a galvanized steel sheet.

3. In ion

An In-ion content of over 3,000ppm in a galvanizing bath does not degrade the formation of a galvanizing film, the adhesion of the galvanizing film to a steel sheet and the adaptability to chromating of an electro-galvanized steel sheet, but causes formation of deposits on a galvanizing electrode, thus making it difficult to carry on galvanizing operations. An In-ion content of under 10ppm, on the other hand, brings about no improvement in the adaptability to chromating of an electro-galvanized steel sheet.

In a galvanizing bath of the present invention, chromium sulfate, chromium nitrate or chromium-ammonium sulfate is used as an additive to form $Cr^{3+}$, and bichromic acid, chromic acid, or an alkali or an ammonium salt thereof is employed as an additive to form $Cr^{6+}$. Because $Cr^{3+}$ cannot be easily dissolved in a galvanizing bath, it is advisable to dissolve in advance said additive in hot water and add the solution into the galvanizing bath to facilitate dissolution of $Cr^{3+}$ into the galvanizing bath.

In a galvanizing bath of the present invention, preferable additives to form Sn ion include stannous sulfate, stannic sulfate, stannous chloride and stanic chloride, and preferable additives to form In ion include indium sulfate and indium chloride.

Conditions for a chromate treatment of an electro-galvanized steel sheet following an electro-galvanizing treatment in the present invention may be conventional ones. For example, an electro-galvanized steel sheet may be chromated in a chromating bath containing $CrO_3$: 5–20 g/l with slight amounts of phosphoric and sulfuric acids as additives at a bath temperature of about 40° C for about 2 to 8 seconds.

The present invention is explained more in detail with reference to examples in comparison with some cases for comparison.

EXAMPLE a. Chemical composition of base galvanizing bath:
$ZnSO_4.7H_2O$:440 g/l,
$ZnCl_2$:90 g/l,
$NH_4Cl$:12 g/l,
$(CH_2COONa)_2.6H_2O$:12 g/l, b. Conditions for electro-galvanizing treatment:
Cathodic current density:45 A/dm$^2$,
Bath temperature:50° C,
pH:4.0,
Target amount of deposited zinc:18 g/m$^2$;

c. Conditions for chromate treatment:
Chemicals: Solution made by Nihon Parkerizing Co., Ltd.,
Free Acid (*F.A.):5.5 point, Bath temperature:40° – 45° C,
Treating time:4 sec, (*F.A. point is an indication of the free acid concentration represented by the amount of NaOH consumption in ml, obtained by using brom cresol green, and by titrating 0.1 Normal-NaOH into a 5ml chromating solution.)

In subjecting a steel sheet to an electro-galvanizing treatment and then subjecting said electro-galvanized steel sheet to a conventional chromate treatment under the conditions given in (a) to (c) above, $Cr^{3+}$, $Cr^{6+}$ and Sn and/or In ions were added into the base galvanizing bath mentioned in (a) above in amounts as shown in the following table. Then, the amount of deposited chromate on the electro-galvanized steel sheet after said chromate treatment and the condition of rust occurrence in a salt spray test were measured. The results of measurement are also indicated in said table.

| | Additive into base galvanizing bath and amount of addition (ppm) | | Amount of deposited chromate (mg/m$^2$) | Salt spray test: Hours before white rust occurrence (hr) | Salt spray test: Hours before red rust occurrence (hr) |
|---|---|---|---|---|---|
| Comparison 1 | None | | 18 | 48 | 144 |
| Comparison 2 | $Cr^{6+}$ | 150 | 45 | 72 | 192 |
| | $Cr^{6+}$ | 10 | | | |
| Comparison 3 | | | 20 | 48 | 144 |
| | Sn ion | 5 | | | |
| | $Cr^{6+}$ | 100 | | | |
| Comparison 4 | | | Galvanizing film not formed | | |
| | Sn ion | 8000 | | | |
| Comparison 5 | Sn ion | 300 | 38 | 72 | 192 |
| | $Cr^{6+}$ | 150 | | | |
| Example 1 | | | 82 | 120 | 288 |
| | Sn ion | 500 | | | |
| | $Cr^{6-}$ | 100 | | | |
| Example 2 | | | 70 | 120 | 288 |
| | Sn ion | 500 | | | |
| | $Cr^{3+}$ | 300 | | | |
| Example 3 | | | 65 | 96 | 288 |
| | Sn ion | 30 | | | |
| | $Cr^{6+}$ | 150 | | | |
| Example 4 | | | 80 | 96 | 288 |
| | In ion | 1000 | | | |
| | $Cr^{3+}$ | 300 | | | |
| Example 5 | In ion | 500 | 78 | 96 | 312 |
| | Sn ion | 1000 | | | |

As is evident from the table above, in Comparison 1, outside the scope of the present invention, in which the base galvanizing bath contains no additives of the present invention, there is only a small amount of chromate deposited on the galvanizing layer on the electro-galvanized steel sheet in applying a chromate treatment to said electro-galvanized steel sheet, this corresponding to a low adaptability to chromating; in the salt spray test on a chromated electro-galvanized steel sheet, the time before occurrence of white and red rusts is short, indicating a rather low corrosion resistance. In Comparison 2, outside the scope of the present invention, in which the base galvanizing bath contains $Cr^{6+}$ only, both the amount of deposited chromate and the results of the salt spray test are better than in Comparison 1 but worse than in Examples 1 to 5 of the present invention. In Examples 1 to 5 of the present invention, in contrast, the amount of deposited chromate and the time before occurrence of white and red rusts are largely improved. In adding additives of the present invention into a base galvanizing bath, an additive content outside the scope of the present invention brings about only a small amount of deposited chromate and a short time before the occurrence of white and red rusts, as shown in Comparisons 3 to 5. Especially in Comparison 4, no galvanizing film is formed. In view of these facts, the necessity is evident to limit the content of additives in a base galvanizing bath in the present invention to the values mentioned previously.

According to the present invention, as mentioned above, the deposition of chromate onto an electro-galvanized steel sheet is accelerated in applying a chromate treatment by subjecting a steel sheet to an electro-galvanizing treatment in an acidic galvanizing bath containing $Cr^{3+}$, $Cr^{6+}$, Sn and In ions in amounts as specified above. In manufacturing a chromated electro-galvanized steel sheet, therefore, it is possible to speed up operations through a more rapid chromate treatment. The corrosion resistance of a chromated electro-galvanized steel sheet is largely improved, thus giving industrially useful effects.

What is claimed is:

1. In a process for manufacturing a chromated electro-galvanized steel sheet, which comprises subjecting a steel sheet to an electro-galvanizing treatment in an acidic galvanizing bath, and then subjecting said electro-galvanized steel sheet to a chromate treatment, the improvement characterized by: subjecting a steel sheet to an electro-galvanizing in a Zn-ion based acidic galvanizing bath containing one additive selected from the group consisting of:

| | | |
|---|---|---|
| (a) | $Cr^{3+}$ | 50 – 700ppm, |
| (b) | $Cr^{6+}$ | 50 – 500ppm, and |
| (c) | $Cr^{3+}$and $Cr^{6+}$ | 50 – 700ppm, in which |
| | $Cr^{6+}$being 500ppm at the maximum, | |

and at least one additive selective from the group consisting of;

| | | |
|---|---|---|
| (d) | Sn ion | 10 – 5,000ppm, and |
| (e) | In ion | 10 – 3,000ppm, |

and then, subjecting said electro-galvanized steel sheet to a conventional chromate treatment.

2. A chromated electro-galvanized steel sheet having a galvanizing layer on the surface of said steel sheet as the first layer and a chromate layer deposited on said galvanizing layer as the second layer, characterized in that: said galvanizing layer is formed by electro-galvanizing said steel sheet in a Zn-ion based acidic galvanizing bath containing one additive selected from the group consisting of:

| | | |
|---|---|---|
| (a) | $Cr^{3+}$ | 50 – 700ppm, |
| (b) | $Cr^{6+}$ | 50 – 500ppm, and |
| (c) | $Cr^{3+}$and $Cr^{6+}$ | 50 – 700ppm, in which |
| | $Cr^{6+}$being 500ppm at the maximum, | |

and at least one additive selected from the group consisting of:

| | | |
|---|---|---|
| (a) | Sn ion | 10 – 5,000ppm, and |
| (e) | In ion | 10 – 3,000ppm. |

* * * * *